US010436545B2

(12) United States Patent
Pell

(10) Patent No.: US 10,436,545 B2
(45) Date of Patent: Oct. 8, 2019

(54) ADJUSTABLE ARCHERY TRAINING BOW

(71) Applicant: Matthew Allen-Tesch Pell, Plainfield, IL (US)

(72) Inventor: Matthew Allen-Tesch Pell, Plainfield, IL (US)

(73) Assignee: AccuBow LLC, Peru, IL (US)

( * ) Notice: Subject to any disclaimer, the term of this patent is extended or adjusted under 35 U.S.C. 154(b) by 200 days.

(21) Appl. No.: 15/215,289

(22) Filed: Jul. 20, 2016

(65) Prior Publication Data

US 2017/0023327 A1 Jan. 26, 2017

Related U.S. Application Data

(60) Provisional application No. 62/231,889, filed on Jul. 20, 2015.

(51) Int. Cl.

| | |
|---|---|
| ***F41B 5/14*** | (2006.01) |
| ***A63B 21/00*** | (2006.01) |
| ***A63B 21/02*** | (2006.01) |
| ***A63B 21/055*** | (2006.01) |
| ***A63B 23/035*** | (2006.01) |
| ***A63B 23/12*** | (2006.01) |

(Continued)

(52) U.S. Cl.

CPC ..... *F41B 5/1476* (2013.01); *A63B 21/00069* (2013.01); *A63B 21/026* (2013.01); *A63B 21/0557* (2013.01); *A63B 21/157* (2013.01); *A63B 21/4043* (2015.10); *A63B 23/03508* (2013.01); *A63B 23/1209* (2013.01); *A63B 69/00* (2013.01); *F41B 5/0094* (2013.01); *A63B 2244/04* (2013.01); *F41B 5/1426* (2013.01); *F41B 5/1449* (2013.01); *F41G 1/35* (2013.01); *F41G 1/467* (2013.01)

(58) Field of Classification Search

USPC ..... 434/11, 247; 124/23.1, 24.1, 86; 482/122, 126

See application file for complete search history.

(56) References Cited

U.S. PATENT DOCUMENTS

| | | | |
|---|---|---|---|
| 1,885,962 | A | 11/1932 | Swenson et al. |
| 2,496,140 | A | 1/1950 | Virneburg |

(Continued)

FOREIGN PATENT DOCUMENTS

| | | |
|---|---|---|
| DE | 562787 | 10/1932 |
| DE | 7606299 | 7/1976 |

(Continued)

OTHER PUBLICATIONS

International Search Report and Written Opinion for related International Application No. PCT/US2016/043166, dated Dec. 1, 2016.

(Continued)

*Primary Examiner* — Kurt Fernstrom

(74) *Attorney, Agent, or Firm* — Barnes & Thornburg LLP

(57) ABSTRACT

An adjustable archery training bow assembly includes a single resistance element and an adjustment mechanism that can be actuated by a user to vary the tension level in the resistance element for training purposes. The training bow also includes an integrated laser sight that allows the user to precisely aim at a target. The adjustable archery training bow is used to enhance the user's skills, such as his/her strength, stability and accuracy in delivering an arrow fired from a real, non-training bow to the target.

20 Claims, 8 Drawing Sheets

(51) Int. Cl.

| | |
|---|---|
| ***A63B 69/00*** | (2006.01) |
| ***F41B 5/00*** | (2006.01) |
| *F41G 1/35* | (2006.01) |
| *F41G 1/467* | (2006.01) |

(56) References Cited

U.S. PATENT DOCUMENTS 2,769,179 A 11/1956 Love
2,929,372 A 3/1960 Vance
2,996,059 A 8/1961 Vance
3,004,532 A 10/1961 Vance
3,072,115 A 1/1963 Johnson
3,108,583 A 10/1963 Andis
3,256,015 A 6/1966 Perrin
3,462,142 A 8/1969 Sterndale
3,494,346 A 2/1970 Yount
3,529,820 A 9/1970 Templeton
3,665,911 A 5/1972 Altier
3,747,593 A 7/1973 Taylor
3,749,075 A 7/1973 Saunders
3,762,222 A 10/1973 Garot et al.
3,800,774 A 4/1974 Troncoso
3,853,111 A 12/1974 Stanislawski et al.
3,966,204 A 6/1976 Dubach
3,983,860 A 10/1976 Bolton
4,026,549 A 5/1977 Gunn
4,041,926 A 8/1977 Troncoso et al.
4,057,246 A 11/1977 Wilson
4,066,051 A 1/1978 Alban
4,079,933 A 3/1978 Everroad
4,090,706 A 5/1978 Reda
4,156,417 A 5/1979 Fletcher
4,160,437 A 7/1979 Fletcher
4,222,302 A 9/1980 Sanfilippo
4,245,840 A 1/1981 Van Housen
4,251,071 A 2/1981 Norton
4,279,601 A 7/1981 Cobelli
4,326,708 A 4/1982 Hinds
4,328,965 A 5/1982 Hatfield
4,334,678 A 6/1982 Doyel
4,403,594 A 9/1983 Todd
4,426,989 A 1/1984 Sutton
4,441,707 A 4/1984 Bosch
4,458,657 A 7/1984 Stockmar
4,478,414 A 10/1984 Molloy
4,489,705 A 12/1984 Larson
4,509,497 A 4/1985 Garvison
4,539,968 A 9/1985 Garvison
4,544,155 A 10/1985 Wallenbrock et al.
4,552,356 A 11/1985 Brousseau
4,591,150 A 5/1986 Mosher
4,593,674 A 6/1986 Kudlacek
4,605,223 A 8/1986 Rainville
4,609,191 A 9/1986 Remme
4,612,907 A 9/1986 Gantt
4,683,865 A 8/1987 Troncoso
4,708,341 A 11/1987 Paraskevakos
4,739,744 A 4/1988 Nurney
4,741,320 A 5/1988 Wiard
4,741,528 A 5/1988 Church
4,757,799 A 7/1988 Bozek
4,848,306 A 7/1989 Treaster
4,854,212 A 8/1989 Levin et al.
4,854,293 A 8/1989 Roberts
4,860,720 A 8/1989 Todd
4,887,584 A 12/1989 Carella
4,909,232 A 3/1990 Carella
4,930,485 A 6/1990 Kopper
4,961,264 A 10/1990 Topel
4,986,250 A 1/1991 Darlington
5,009,216 A 4/1991 Ross
5,016,557 A 5/1991 Miller
5,052,365 A 10/1991 Carella
5,054,463 A 10/1991 Colley et al.
5,056,784 A 10/1991 Craig
5,065,732 A 11/1991 Smith
5,070,856 A 12/1991 Plummer
RE34,126 E 11/1992 Todd
5,163,413 A 11/1992 Carella
5,165,584 A 11/1992 Meagher et al.
5,174,577 A 12/1992 Warde et al.
5,277,170 A 1/1994 Carella
5,314,396 A 5/1994 Parr
5,353,780 A 10/1994 Carella
5,367,780 A * 11/1994 Savage ..... F41G 1/467 124/87
5,411,460 A 5/1995 Karlson et al.
5,484,368 A 1/1996 Chang
5,503,135 A 4/1996 Bunk
5,592,928 A 1/1997 Frasier
5,639,244 A 6/1997 Stricklin
5,653,213 A 8/1997 Linsmeyer
5,704,855 A 1/1998 Kellogg, Jr.
5,741,207 A 4/1998 Buoni et al.
5,746,687 A 5/1998 Vial et al.
5,860,655 A 1/1999 Starrett
5,885,196 A 3/1999 Gvoich
6,032,661 A 3/2000 Goff et al.
6,425,765 B1 7/2002 Irwin
6,499,478 B1 12/2002 Perez
6,726,606 B2 4/2004 Jacobsen
6,776,148 B1 8/2004 Islas
6,860,816 B2 3/2005 Bond et al.
6,935,863 B2 8/2005 Frigon
7,047,958 B1 5/2006 Colley
7,087,001 B1 8/2006 Ihli
7,216,643 B2 5/2007 Pellerite
7,322,909 B1 1/2008 Loccaroni et al.
7,387,599 B1 6/2008 Hsu
7,465,259 B2 12/2008 Mok
7,605,317 B2 10/2009 Chen et al.
7,618,356 B1 11/2009 Johnson et al.
7,622,663 B2 11/2009 Casillas et al.
7,708,674 B1 5/2010 Saunders
D617,856 S 6/2010 Brinser
7,854,694 B1 12/2010 Frunzi
7,926,476 B1 4/2011 Tentler et al.
8,052,553 B2 * 11/2011 Jones ..... F41B 5/14 473/578
8,079,942 B2 12/2011 Laporte et al.
8,273,973 B2 9/2012 Kimmons et al.
8,282,493 B2 * 10/2012 Roman ..... F41G 1/467 463/2
8,403,818 B1 3/2013 Wilkinson et al.
8,430,282 B2 4/2013 Sellers
8,507,779 B1 8/2013 Chen
8,583,446 B2 11/2013 Williams
8,657,708 B2 2/2014 Pijanowski
8,771,154 B2 7/2014 Fedriga
9,163,913 B2 10/2015 Laporte et al.
9,254,405 B1 2/2016 Marji
9,633,573 B1 * 4/2017 Tafoya ..... G09B 19/0038
2002/0086779 A1 7/2002 Wilkinson
2002/0160891 A1 10/2002 Gallagher
2003/0003425 A1 1/2003 Frigon
2003/0096679 A1 5/2003 Schlueter
2003/0131837 A1 7/2003 Bruman
2004/0014010 A1 1/2004 Swensen et al.
2004/0043822 A1 3/2004 Bond et al.
2005/0123883 A1 * 6/2005 Kennen ..... F41G 3/2611 434/11
2005/0239617 A1 10/2005 Tenaglia
2006/0024651 A1 2/2006 Davis
2007/0193568 A1 8/2007 Lee
2007/0254786 A1 11/2007 Owen
2008/0032876 A1 2/2008 Mukenev
2009/0188369 A1 7/2009 Chen et al.
2009/0211432 A1 8/2009 Casillas et al.
2010/0075819 A1 3/2010 Maki
2010/0152002 A1 6/2010 Knight
2010/0204024 A1 8/2010 Mills et al.
2010/0263650 A1 10/2010 Dahl, II et al.
2011/0028288 A1 2/2011 Anderson
2011/0094365 A1 4/2011 Kimmons et al.

(56) References Cited

U.S. PATENT DOCUMENTS

| | | | | |
|---|---|---|---|---|
| 2011/0260404 | A1 | 10/2011 | Laporte et al. | |
| 2012/0012621 | A1 | 1/2012 | Sellers | |
| 2012/0052988 | A1 | 3/2012 | Pijanowski | |
| 2013/0154191 | A1 | 6/2013 | Laporte et al. | |
| 2013/0247399 | A1* | 9/2013 | Evans | F41G 1/467 33/265 |
| 2014/0038793 | A1 | 2/2014 | Hetzel | |
| 2014/0113779 | A1 | 4/2014 | Loach | |
| 2014/0261355 | A1 | 9/2014 | Peacemaker et al. | |
| 2014/0318520 | A1 | 10/2014 | Laporte et al. | |
| 2015/0300769 | A1 | 10/2015 | Heisser | |
| 2016/0086507 | A1 | 3/2016 | Winters-Huete | |
| 2017/0167823 | A1* | 6/2017 | Kirilov | F41B 5/1476 |

FOREIGN PATENT DOCUMENTS

| | | | |
|---|---|---|---|
| DE | 2917834 | | 11/1980 |
| DE | 3231228 | | 2/1984 |
| DE | 202007002080 | U1 | 4/2007 |
| FR | 728948 | A | 7/1932 |
| FR | 2647200 | A1 | 11/1990 |
| FR | 2707748 | | 1/1995 |
| GB | 434067 | | 8/1935 |
| JP | 53105097 | A | 9/1978 |
| JP | 2000219865 | A | 8/2000 |
| JP | 3096376 | B2 | 10/2000 |
| JP | 2000302926 | A | 10/2000 |
| JP | 2002352834 | A | 12/2002 |
| JP | 2003034400 | A | 2/2003 |
| JP | 2007215996 | A | 8/2007 |
| JP | 4668895 | B2 | 4/2011 |
| KR | 20130022664 | A | 3/2013 |
| MX | 2010004591 | A | 10/2011 |
| WO | 03000349 | | 1/2003 |
| WO | WO91/06820 | | 11/2007 |

OTHER PUBLICATIONS

Techniq Archery Training Device, Apr. 2014.
Miller Archery Training Device, https://web.archive.org/web/20120222034909/http://bowhunting.net:80/2012/02/releasing-for-increased-accuracy-with-back-tension, Feb. 22, 2012.
Firing-Line, https://web.archive.org/web/20111210172701/http://www.sausa.com:80/category.php?category=41, Dec. 10, 2011.
Win & Win Stretching Band,https://web.archive.org/web/20110311220808/https://www.abbeyarchery.com.au/p/WWWSB/Win+%26amp%3B+Win+Scapower+Stretching+Band.html, Apr. 14, 2013.
Bow Fit, https://web.archive.org/web/20120328070500/http://www.bowfit.com:80/products.html#bowfit, Mar. 28, 2012.
Morin Archery Trainer, Sep. 21, 2012.
Kyudo Trainer, https://zensekai.wordpress.com/category/international-marriage/page/2/, May 27, 2011.
Kyudo Trainer, http://www.dannychoo.com/en/post/25877/Kyudo.html, Oct. 21, 2012.
Toxoshot Archery Training Bow, Mar. 9, 2011.
Bow Trainer, https://web.archive.org/web/20121114065101/http://www.lancasterarchery.com/prairie-innovators-bow-trainertm-training-device.html, Nov. 14, 2012.
Archery Practice Loop, https://web.archive.org/web/20110306044903/http://archeryreport.com:80/2010/05/archery-practice-loop-tool-thousand/, Mar. 6, 2011.
YouTube D-Loop Video, https://www.youtube.com/watch?v=50Tu5cQOcX8, Apr. 28, 2014.
D-Loop Article, https://web.archive.org/web/20120110005345/http://archeryreport.com/2012/01/bowstring-dloops-torqueless-loops-variations-advantages-disadvantages/, Jan. 10, 2012.
YouTube D-Loop Video, https://www.youtube.com/watch?v=_6AojeoAQpw, Dec. 22, 2010.
YouTube D-Loop Video, https://www.youtube.com/watch?v=Yz88pX-Eoll, Feb. 20, 2014.
D-Loop Article, https://web.archive.org/web/20140204042515/http://www.archery.org.au/FAQs/Equipment/How-to-attach-D-Loops, Feb. 4, 2014.
YouTube D-Loop Video, https://www.youtube.com/watch?v=4qytQDzWj_A, Nov. 12, 2009.
ArcheryHistory.com, https://web.archive.org/web/20081208234308/http://www.archeryhistory.com:80/releases/releases.htm, Dec. 8, 2008.
Bow Release Aids Article, https://1source.basspro.com/index.php/component/k2/85-archery/851-breaking-down-the-different-bow-release-aids, May 8, 2013.
Release Aids Article, http://www.bow-international.com/features/mastering-the-release-aid/, Apr. 11, 2013.

* cited by examiner

ADJUSTABLE ARCHERY TRAINING BOW

CROSS-REFERENCE TO RELATED APPLICATIONS

This application claims priority to, under 35 U.S.C. § 119, U.S. Provisional Application No. 62/231,889 filed on Jul. 20, 2015, the entire content of which is hereby incorporated by reference in its entirety for all purposes.

TECHNICAL FIELD

This disclosure relates to an adjustable archery training bow that includes a single resistance element and an adjustment mechanism that can be actuated by a user to selectively vary the tension level in the resistance element for training purposes.

BACKGROUND

Archery is a sport that dates back centuries and archery practice, hunting and competitions can be found world-wide. An archer's technique, in terms of the archer's balance, stability, composure and strength, is critical for ensuring accuracy, range and consistency in delivering an arrow to the target. These skills can be acquired or improved through continual practice at different draw weights for the bow. However, such practice may be difficult considering time, financial or equipment constraints. Regarding this last constraint, there is no conventional training bow that provides an adequate platform for easily varying the draw weight without the use of extraneous tools and/or equipment. The ability to practice using multiple draw weights is also limited by the fact an archer would need access to a range of bows with correspondingly different draw weight ranges, as most conventional bows have a draw weight range of only 30 pounds, at the most. Further, conventionally practicing the release of a bow is a crucial aspect of ensuring accuracy, range and consistency in delivering an arrow to the target. However, practicing the release of a conventional bow can only be achieved by releasing a live arrow, which requires an adequate facility, along with multiple arrows. Dry-firing, or firing a conventional bow without an arrow may damage a conventional bow. With a training bow that does not fire live arrows, users are limited to interacting with the bow and aiming in similar fashion as they would a conventional bow. Another shortcoming of existing training bows is that many, if not all, lack a sense of realism in bow size, shape and weight.

Accordingly, there is an unmet need for an adjustable archery training bow able to provide an archer with variable draw weights via a single resistance band, while being operable in nearly any environment, including indoors, and allowing the archer to repeatedly practice releasing an arrow by dry-firing the training bow with the use of a sighting device to increase the archer's accuracy.

SUMMARY

The present disclosure provides an adjustable archery training bow that includes a single resistance element and a tension adjustment mechanism that can be actuated by a user to selectively vary the tension level in the resistance element for training purposes. Because the single resistance element can be selectively varied by the user, multiple resistance elements or bands are not necessary which significantly improves the functionality and versatility of the disclosed adjustable training bow.

An adjustable archery training bow assembly may include a main body, and a resistance member disposed between a first end of the main body and a second end of the main body, wherein a first end of the resistance member is fixedly attached to the first end of the main body and a second end of the resistance member is attached to the second end of the main body by an adjustable tension mechanism that permits a user to vary the tension of the resistance member.

Other features and advantages of the disclosure will be apparent from the following specification taken in conjunction with the following drawings.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
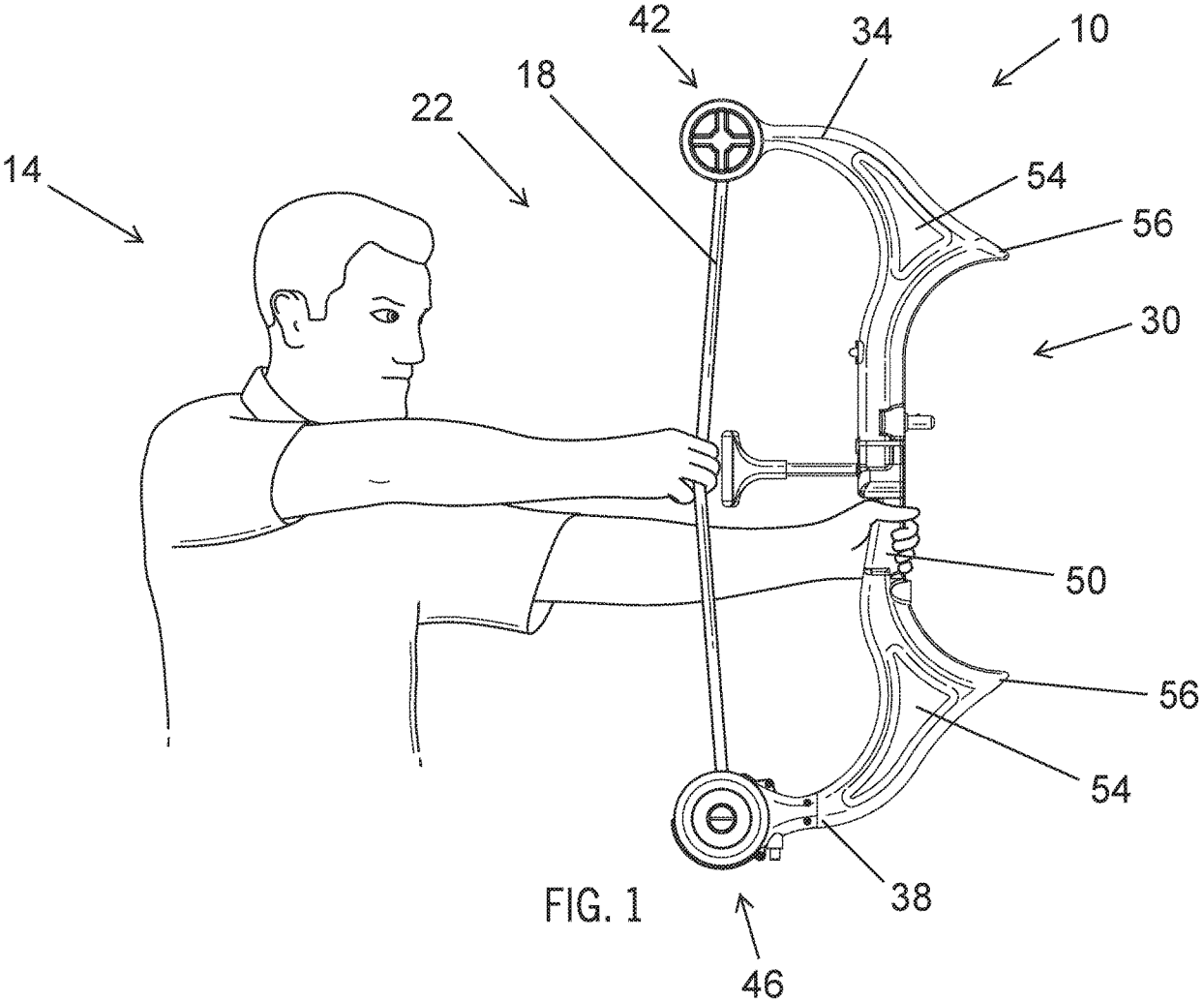
FIG. 1 illustrates an adjustable archery training bow according to an embodiment of the present disclosure, showing a resistance element of the training bow being drawn by a user from an initial position.

While this disclosure includes a number of details and embodiments in many different forms, there is shown in the drawings and will herein be described in detail particular embodiments with the understanding that the present disclosure is to be considered as an exemplification of the principles of the disclosed methods and systems, and is not intended to limit the broad aspects of the disclosed concepts to the embodiments illustrated.

This disclosure relates to an adjustable archery training bow 10 including a single resistance element 18 and an adjustment mechanism 170 that can be actuated by a user 14 to vary the tension level in the resistance element 18 for training purposes. The adjustable archery training bow 10 is used to enhance the user's skills, such as his/her strength, stability and accuracy in delivering an arrow fired from a real, non-training bow to the target. The tension level in the resistance element 18 determines the draw weight of the element 18 at a particular setting. By using the adjustment mechanism 170 to vary the tension level of the element 18, the user 14 can selectively vary the draw weight of the training bow 10 which improves the user's strength while training with the bow 10.

Figure 2:
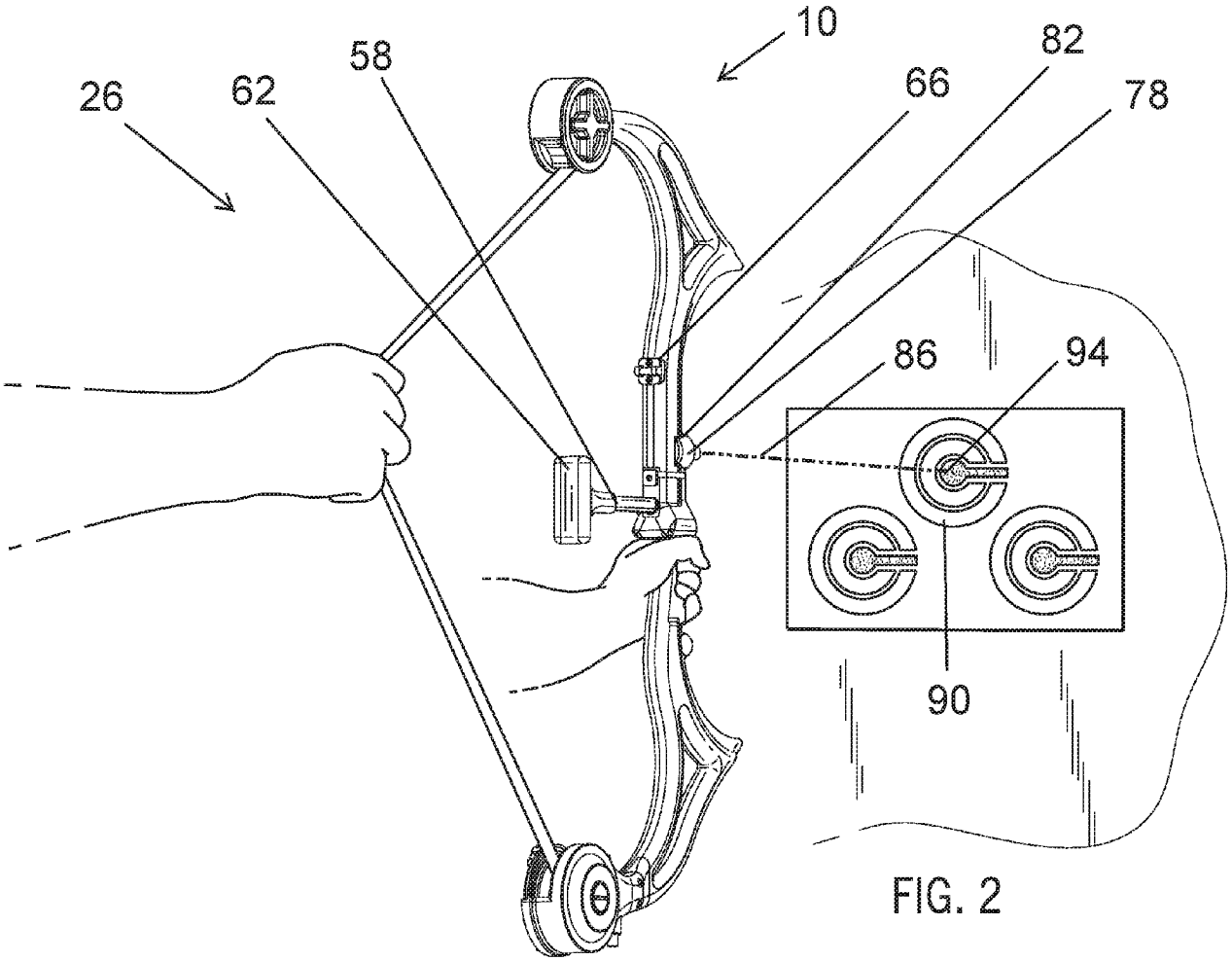
FIG. 2 is a perspective view of the training bow of FIG. 1, showing the user drawing the resistance element to a drawn position and a laser pointed on a wall-mounted target.
Figure 3:
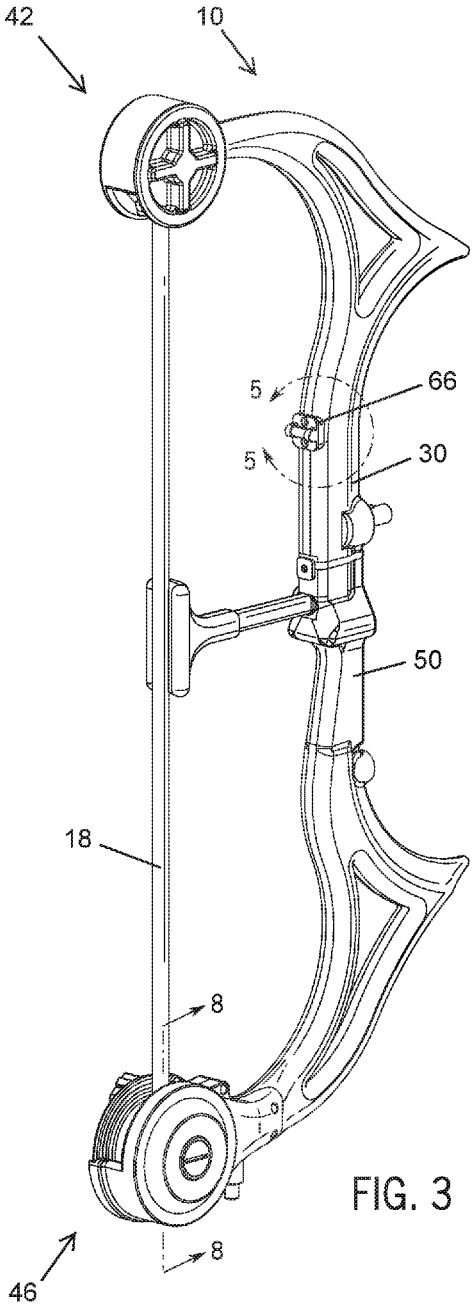
FIG. 3 is a right perspective view of the training bow.
Figure 4:
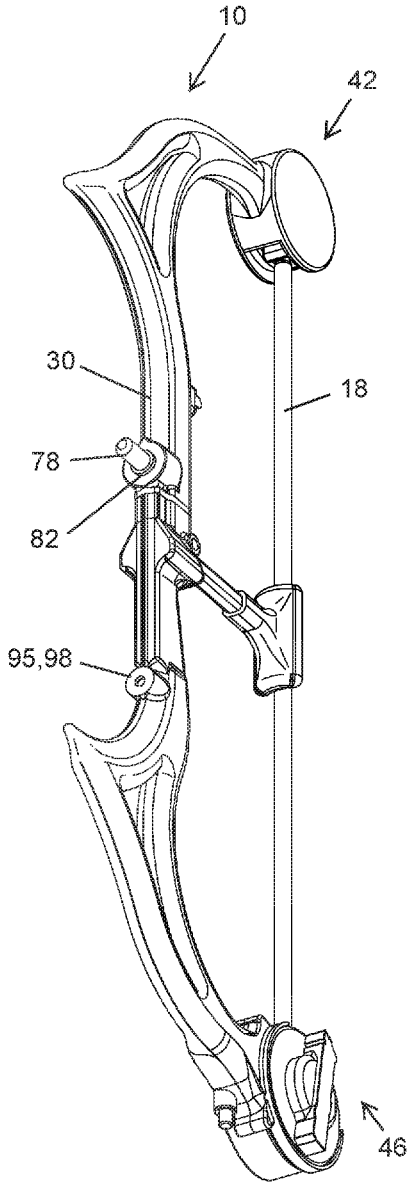
FIG. 4 is a left perspective view of the training bow.

As shown in FIGS. 1 and 2, the training bow 10 includes the resistance element 18 and a main body 30 including a first limb 34 and a second limb 38. In the embodiment shown in the Figures, the element 18 is configured as a flexible band or rubber tube that extends between a first end 42 of the first limb 34 and a second end 46 of the second limb 38. The main body 30 also includes an integral grip 50 formed in the second limb 38, where the user 14 places his hand to grasp the training bow 10. The main body 30 includes one or more apertures 54 formed adjacent to horns 56. In FIG. 1, the user 14 has begun to draw the resistance element 18 from an initial or first position 22. FIG. 2 shows the user 14 further drawing the resistance element 18 to a second or drawn position 26, where due to the change in its geometry, the resistance element 18 has increased tension compared to that of the first position.

The training bow 10 also includes a vibration damper 58 that extends laterally and rearward from the main body 30, preferably from a location above the grip 50. The vibration damper 58 terminates in a damper end 62, a rearward-facing surface of which may be concave in shape. When the user 14 draws and releases the resistance element 18, the released resistance element 18 contacts the damper end 62, and vibrations and energy from the released resistance element 18 are reduced through contact with the damper end 62.

Figure 5:
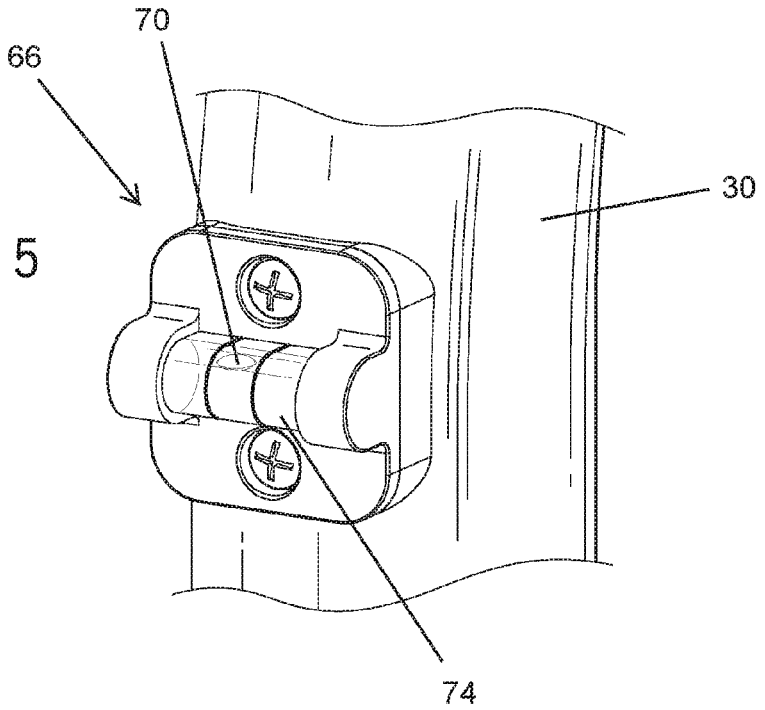
FIG. 5 illustrates a level mounted to a portion of the training bow.

The main body 30 may also include a level 66, as best shown in FIGS. 2 and 5. The level 66 indicates the orientation of the bow 10 to the user 14, about an axis or a surface (e.g., the ground). Thus, the user 14 can quickly and easily determine an orientation of the bow 10 about the axis, which may be an axis coincident with, or substantially parallel to, a laser beam 86, described below. The level 66 can be a mechanical level that includes a gas bubble 70 within a fluid 74 in a marked tube. An instant location of the gas bubble 70 within the fluid 74 provides the user 14 with a simple and reliable orientation indicator for bow 10.

The main body 30 of the training bow 10 also includes a laser sight 78. The laser sight 78 mounts to the main body 30 via a laser port 82. As shown in FIG. 2, the laser sight 78 produces the laser beam 86 originating from the laser sight 78 and travelling to a target 90. Upon reaching the target 90, the laser beam 86 produces a visible laser point 94 on the target 90. By watching the laser beam 86 and/or the laser point 94, the user 14 can monitor stability and consistency when using the training bow 10, namely drawing and releasing the resistance element 18. The main body 30 may also include one or more attachment ports 95. One or more of the attachment ports 95 may be a stabilizer port 98, and may be used to mount a stabilizer (not shown). The stabilizer port 98 allows users 14 to attach a conventional bow stabilizer to adjust the weight and forward balance of the adjustable archery training bow 10 based on user 14 preference, such that the user 14 can simulate the feel of a conventional bow that they use to fire live arrows.

Figure 6:
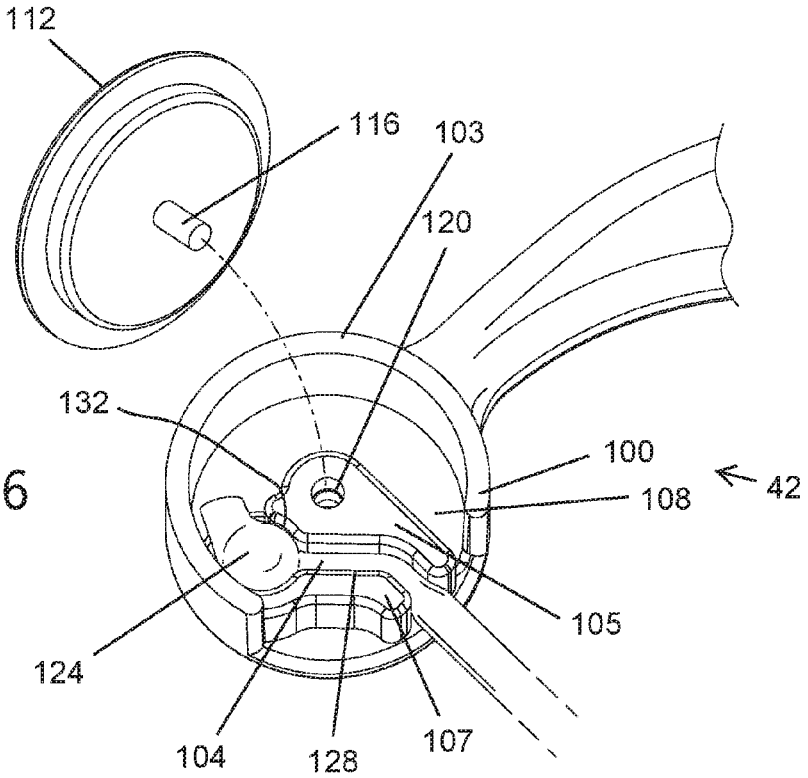
FIG. 6 illustrates a first housing of the training bow, showing a first end of a resistance element secured within the first housing.

The first end 42 of the main body 30 includes a first housing 100 that receives and secures a first end 104 of the resistance element 18, as shown in FIG. 6. The first housing 100 includes a side wall 103 that extends along a substantial extent of the periphery of the housing 100 while exposing a gap that allows for reception of the resistance element 18, as discussed below. A first housing cover 112 is removably attached to the first housing 100 to define a first housing cavity 108. A first housing fastener 116, such as a pin or threaded screw, extends from an inner surface of the first housing cover 112 and is received by a receptacle 120 formed in a first internal retaining body 105 of the first housing 100, wherein the cover 112 is removably connected to the housing 100. The first housing 100 also includes a second internal retaining body 107 that is cooperatively positioned with the first internal retaining body 105 to define a retaining channel 128 that extends inward from a periphery of the first housing 100. The removable connection between the first housing cover 112 and the first housing 100 allows the user 14 to access to the first housing cavity 108 for maintenance or replacement of the resistance element 18 and/or the first end 104 of the element 18.

The resistance element first end 104 may include a first securing element 124, such as a bead, ball-bearing, rod and pin that is located within the first end 104. Alternatively, the first end 104 could be tied in a knot to define the securing element 124. By various mechanical means, including crimping, adhesives or other techniques, the first securing element 124 is securely attached to the resistance element first end 104. A portion of the resistance element first end 104 extends through the retaining channel 128 and reaches a first receptacle 132 which securely retains the first securing element 124 and an adjacent extent of the resistance element first end 104, thus securing the first end 104 of the resistance element 18 to the first end 42. The second end 46 of the main body 30 includes a second housing 136 that adjustably secures a second end 152 of the resistance element 18, as shown in FIGS. 7-13. The second housing 136 includes a circular side wall 138 that mates with a second housing cover 140 to cooperatively form a second housing cavity 144. By various mechanical arrangements and as discussed below, the second housing cover 140 is rotatably connected to the second housing 136. Similar to the first securing element 124, a second securing element 148 is securely attached to the resistance element second end 152. The second securing element 148 may a bead or ball-bearing that is enclosed within or retained by a resistance element second end 152 by various mechanical means, including crimping, adhesives or other attachment techniques. The second end of the resistance element 152 extends through a second channel 156 formed in a boss 158 extending from an inner surface of the second cover 140 and reaches a second receptacle 160 in the boss 158. The second receptacle 160 securely retains the second securing element 148 and an adjacent extent of the resistance element second end 152, thus securing the second end of the resistance element 152 to the second housing cover 140. Accordingly, as the second housing cover 140 is rotatably connected to the second housing 136, the second end of the resistance element 152 is also rotatably connected to the second housing 136. Further, the second end of the resistance element 152 is also rotatably connected to the second end 46 of the bow 10.

Figure 7:
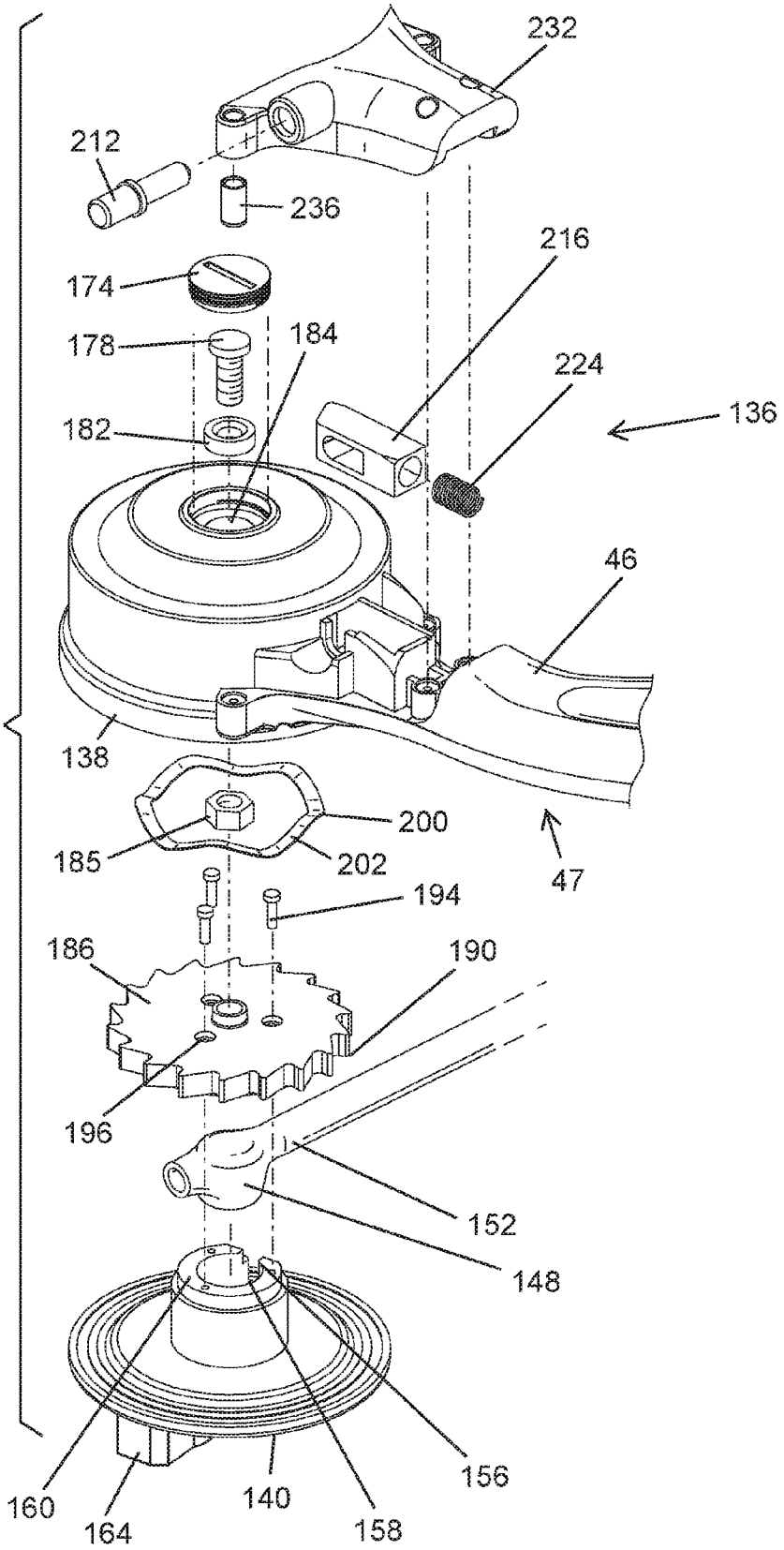
FIG. 7 is an exploded view of a second housing and a tension adjustment mechanism of the training bow.
Figure 8:
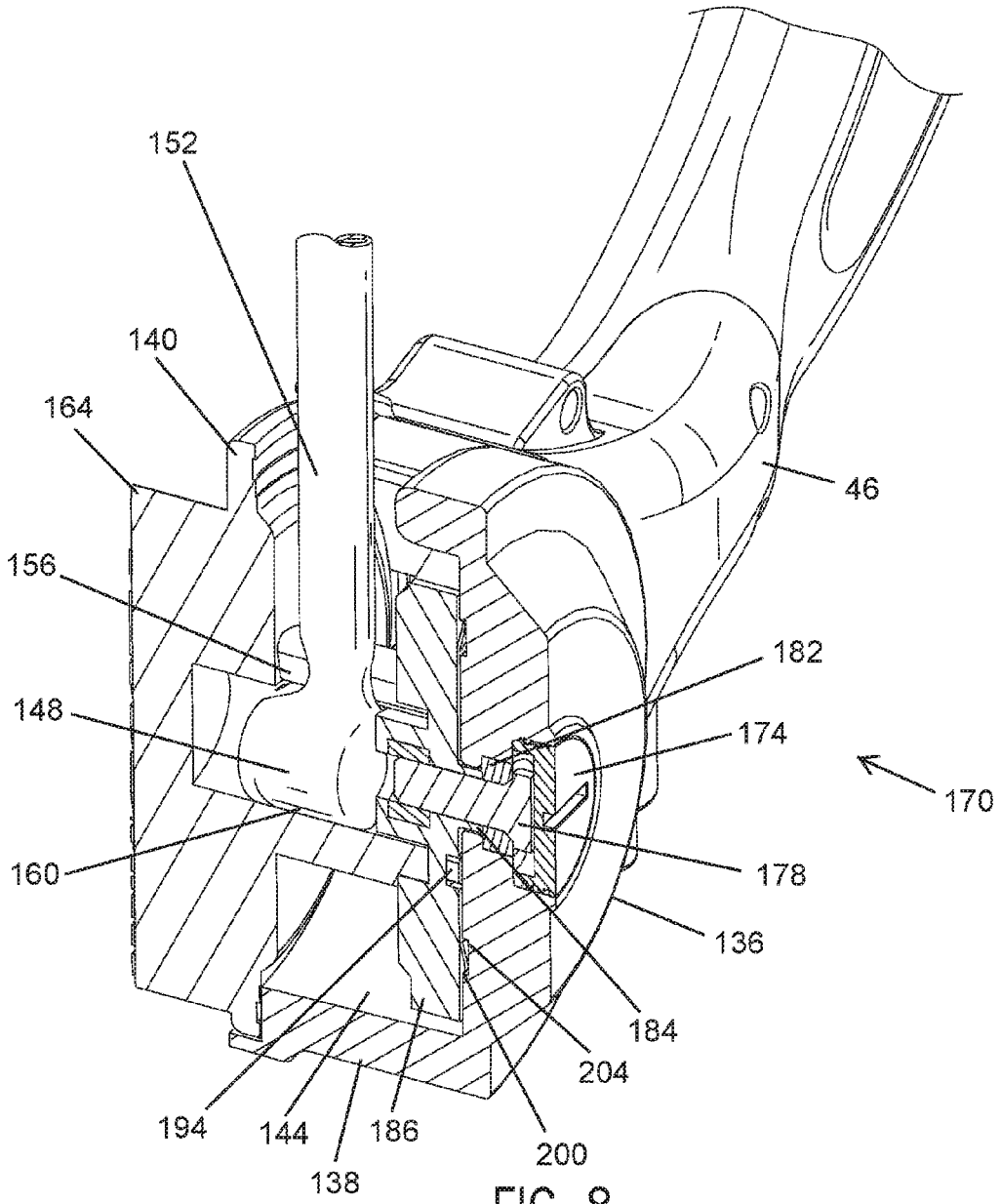
FIG. 8 is a cross-sectional view taken along line 8-8 of FIG. 3, showing the tension adjustment mechanism of the training bow.

As best shown in FIGS. 7 and 8, the second end 46 includes the tension adjustment mechanism 170 that is configured to vary the tension of the resistance element 18 between its first end 104 and second end 152. In an embodiment, the user 14 can vary the tension of the resistance element 18 by manipulating the adjustable tension mechanism 170. In particular, the user 14 can vary the tension of the resistance element 18 by grasping a handle 164 formed on the external surface of the second housing cover 140 and rotating the second housing cover 140 relative to the second housing 136.

Referring to FIGS. 7-13, the adjustment mechanism 170 includes a cover piece 174, a bolt 178, a washer 182, a ratchet wheel 186 and means for restricting undesired rotation 200. The rotation restricting means 200 is configured as a ring 202, washer or spacer. The bolt 178 extends through the washer 182 and a second housing aperture 184 and threadably connects to a ratchet wheel 186 positioned within the second housing 136. Referring to FIG. 8, the bolt 178 threadably attaches to a nut 185 embedded in the ratchet wheel 186. The ratchet wheel 186 includes a plurality of teeth 190 arranged along the outer periphery of the ratchet wheel 186. Fasteners 194, such as screws or pins, extend through wheel apertures 196 and attach to the second housing cover 140 via the boss 158, such that the ratchet wheel 186 rotates with the second housing cover 140 when it is actuated by the user 14. Further, the securing of the ratchet wheel 186 with the boss 158 assists in securing the second securing element 148 and the resistance element second end 152 within the second receptacle 160. The ring 202 is disposed within a circumferential track 204 formed in an internal wall of the second housing 136. The ring 202 is relatively thin metal object with a wavy, non-planar configuration. The ring 202 is further disposed between the second housing 136 and the ratchet wheel 186, whereby the ring 202 serves to frictionally limit rotation between the second housing 136 and the second housing cover 140 by imparting a frictional force on the ratchet wheel 186 and/or the second housing 136.

Figure 12:
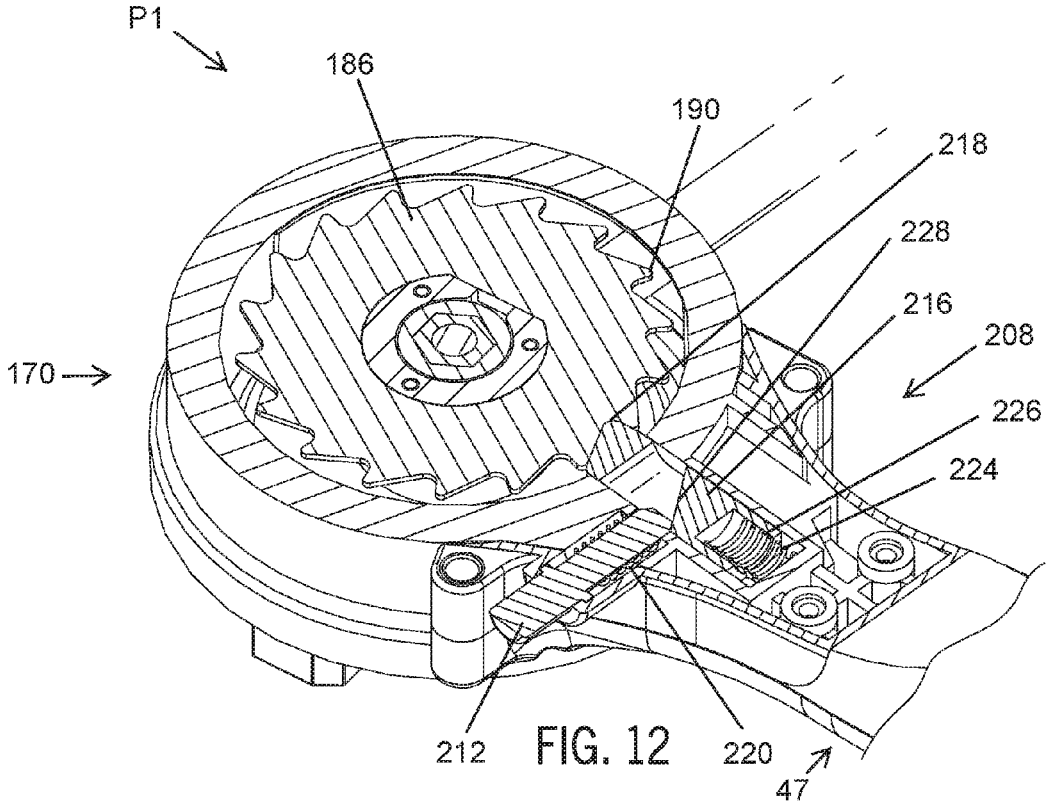
FIG. 12 is a cross sectional view of the tension adjustment mechanism and a release mechanism in a released position.
Figure 13:
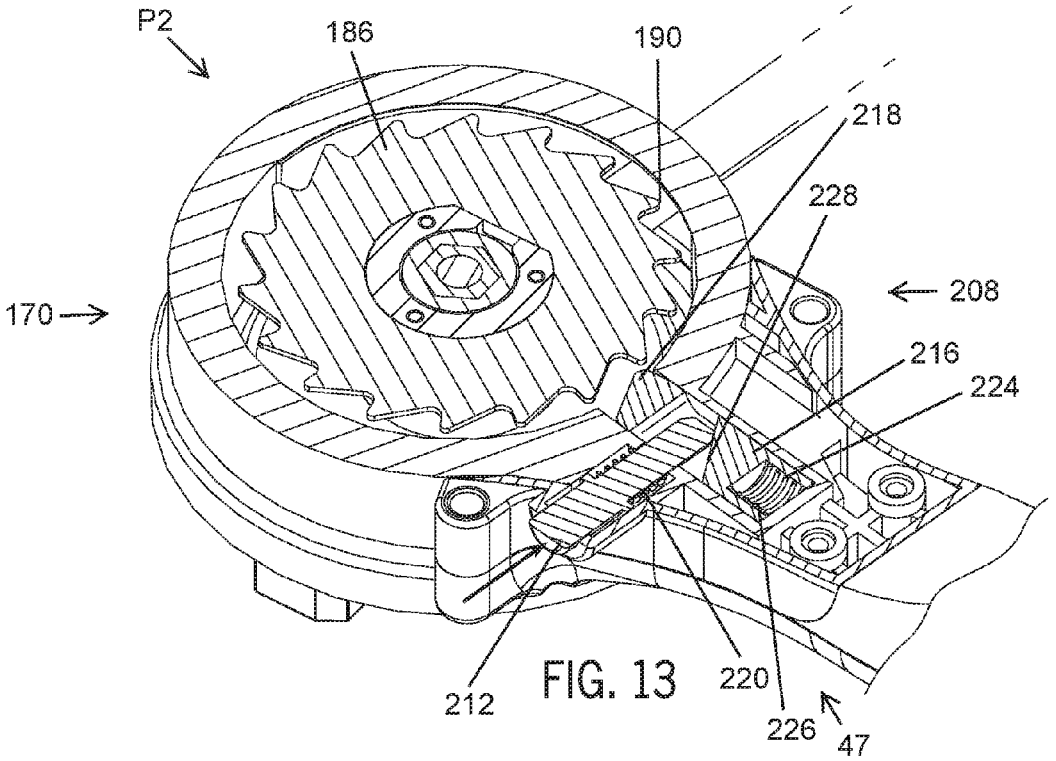
FIG. 13 is a cross sectional view of the tension adjustment mechanism and a release mechanism in an engaged position.

The adjustment mechanism 170 further includes a release mechanism 208 positioned adjacent the second housing 136 in a neck region 47 of the second end 46 of the main body 30. The adjustment mechanism 170 comprises an actuator 212, a pawl 216, a coil spring 220 that receives an extent of the actuator 212 and a coil spring 224 that resides substantially within pawl 216. The pawl 216 is moveable between an engaged positions P1 (see FIG. 12) and a released position P2 (see FIG. 13), the latter causing a tip 218 of the pawl 216 to be engaged with the teeth 190 of the ratchet wheel 186. When the pawl 216 is in the engaged position P1, as illustrated in FIG. 12, the ratchet wheel 186 is rotatable in one direction (e.g., counter-clockwise) but not in another direction (e.g., clockwise). This rotational aspect corresponds to the ratchet wheel 186 being rotatable in a direction that increases the tension in the resistance element 18 while not being rotatable in a direction that decreases the tension in the resistance element 18. When the pawl 216 is in the released position P2, as illustrated in FIG. 13, the ratchet wheel 186 is rotatable in both directions (e.g., counter-clockwise and clockwise). The actuator 212, configured as a depressible button, is biased away from the pawl 216 by the spring 220, while the pawl 216 is biased towards the ratchet wheel 186 and the engaged position P1 by the pawl spring 224, which resides within a cavity 226 formed in the neck region 47 of the second end 46. In operation, the user 14 depresses the actuator 212 inward and toward the pawl 216 in the direction shown by the arrow in FIG. 13. The actuator 212 acts on an inclined surface 228 of the pawl 216 and thereby moves the pawl 216 into the released position. The release mechanism 208, and components thereof, are secured and contained in the second end 46 by a release cover 232. When the user 14 removes pressure from the actuator 212, the actuator 212 moves away from the pawl 216 and the pawl 216 moves towards and into contact with the ratchet wheel 186 and the adjustment mechanism 170 returns to the engaged position P1 of FIG. 12.

Figure 9:
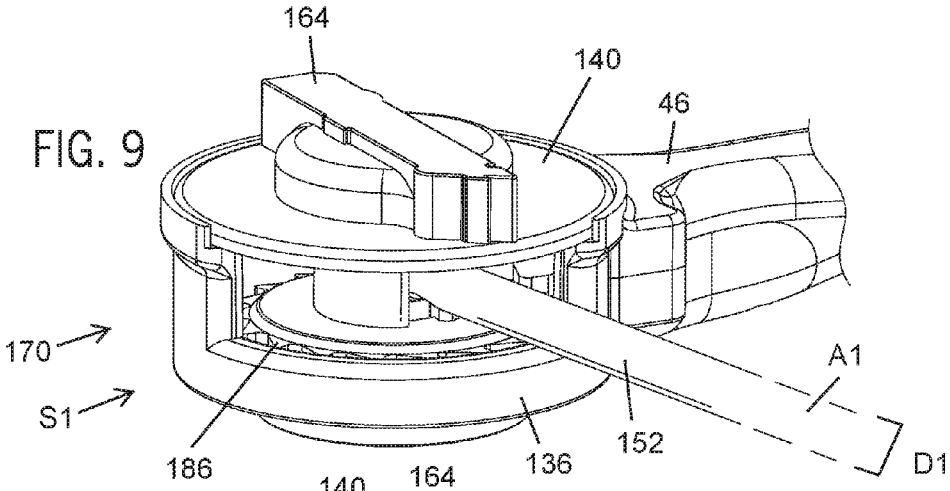
FIG. 9 is a perspective view of the tension adjustment mechanism and the resistance element in a first state.
Figure 10:
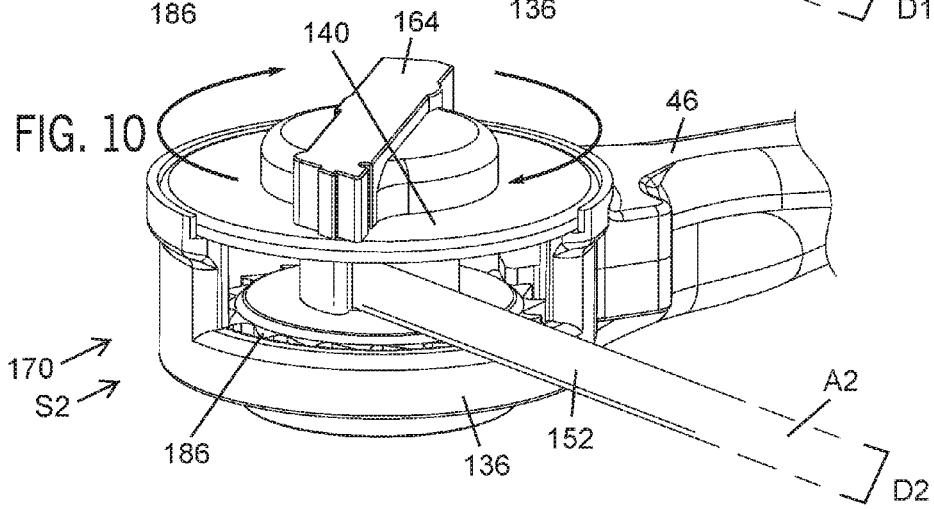
FIG. 10 is a perspective view of the tension adjustment mechanism and the resistance element in a second state.
Figure 11:
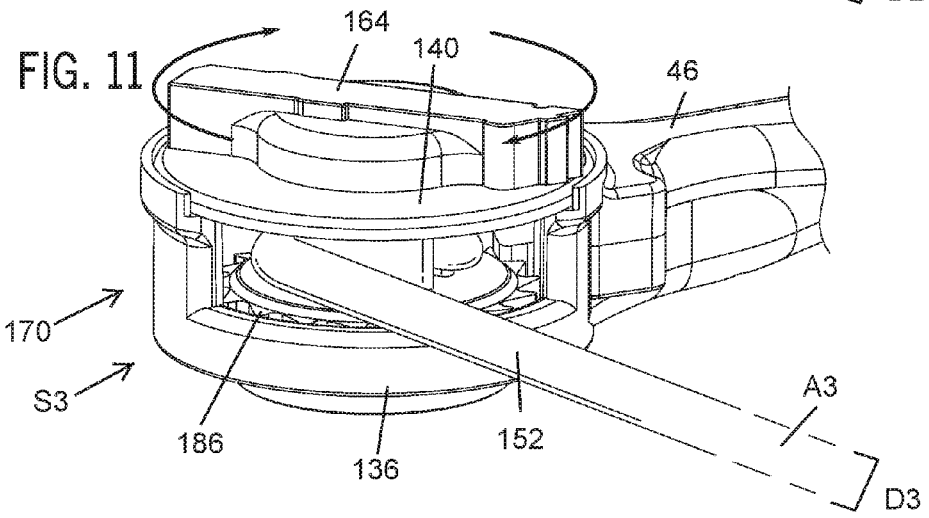
FIG. 11 is a perspective view of the tension adjustment mechanism and the resistance element in a third state.

FIGS. 9-11 illustrate embodiments of first, second and third states, respectively, of the tension adjustment mechanism 170 and the resistance element 18, focusing on the second end 152 of the resistance element 18. The various states impact the draw weight of the element 18, which is a measure of the force needed to pull the element 18 from the initial position (see FIG. 1) to the drawn position P2 (see FIG. 2). FIG. 9 shows the adjustment mechanism 170 and the resistance element 18 in a first state of tension S1. FIG. 10 shows the adjustment mechanism 170 and the resistance element 18 in a second state of tension S2 which places the element 18 in greater tension than that of the first tension state S1. Additionally, the draw weight of the resistance element 18 in the second state S2 is greater than the draw weight of the resistance element 18 in the first state S1. Further, a cross-sectional area A2 and a cross-sectional diameter D2 of the resistance element 18 in the second state S2 is less than a cross-sectional area A1 and a cross-sectional diameter D1 of the resistance element 18 in the first state S1. The user 14 can grasp and actuate the handle 164 to rotate the second housing cover 140 relative to the second housing 136, which selectively increases the tension and draw weight of the resistance element 18. Actuating the handle 164 in the clockwise direction causes the second end of the resistance element 152 to progressively wrap around the second bead receptacle 160 and the boss 158 of the second housing cover 140 and within the second housing cavity 144, thereby increasing the tension between the opposed ends of the element 18 and its draw weight. The user 14 rotates the handle 164 in a clockwise direction shown by the arrow in FIG. 10 to increase the tension of the resistance element 18 and move from the first state S1 to the second state S2.

FIG. 10 shows the resistance element 18 and the adjustment mechanism 170 in a third state of tension S3 which the user 14 has selectively arrived at by further actuating the handle 164. In the third state S3, the element 18 is in greater tension than that of the first or second states S1, S2. Also, the draw weight of the resistance element 18 in the third state S3 is greater than the draw weight in either the first or second states S1, S2. Further, a cross-sectional area A3 and a cross-sectional diameter D3 of the resistance element 18 in the third state is less than cross-sectional areas A1 and A2, as well as cross-sectional diameter D1 and D2 of the resistance element 18. Thus, the cross-sectional area A of and cross-sectional diameter D of the resistance element 18 vary inversely with the tension of the resistance element 18. As the tension of the resistance element 18 increases, the cross-sectional areas and diameters decrease, and as the tension of the resistance element 18 decrease, the cross-sectional areas and diameters increase.

The user 14 can grasp and actuate the handle 164 to rotate the second housing cover 140 relative to the second housing 136 in the manner described above. Further actuating the handle 164 in the clockwise direction causes a greater extent of the second end of the resistance element 152 to progressively wrap around the second bead receptacle 160 and the boss 158 of the second housing cover 140 and within the second housing cavity 144, thereby further increasing the tension between the opposed ends of the element 18 and its draw weight. The user 14 rotates the handle 164 in a clockwise direction shown by the arrow in FIG. 11 to increase the tension of the resistance element 18 and move the second state S2 to the third state S3.

As explained above, the user 14 can actuate the handle 164 of the adjustment mechanism 170 to move the resistance element 18 from the first state S1 to the second state S2 to the third states S3 regardless of the relative position of the pawl 216 and the ratchet wheel 186. However, the engagement between the pawl 216 and the teeth 190 of the ratchet wheel 186 precludes decreasing the tension in the resistance element 18 and moving from the third state S3 to either the second state S2 or the first state S1. To decrease the tension in the resistance element 18 and move from the third state S3 to either the second state S2 or the first state S1, the user 14 depresses the actuator 212 to move the pawl 216 to the released position P2 (see FIG. 13) and turns the handle 164 in the counter-clockwise direction which rotates the second housing cover 140 relative to the second housing 136. This rotation causes an extent of the second end of the resistance element 152 to progressively un-wrap, or unwind, from the second bead receptacle 160 and the boss 158 of the second housing cover 140, whereby the tension in the resistance element 18 is decreased.

When the user 14 wants to decrease the tension in the resistance element 18 and depresses the actuator 212 to move the pawl 216 to the released position P2 as part of the process of reducing the tension, the ring 202 prevents rapid unwinding of the second end of the resistance element 152 from the boss 158 by exerting an internal retaining force on the ratchet wheel 186 that is only overcome by the user 14 physically actuating the handle 164. In this manner, the rotation restricting means 200, for instance the ring 202, frictionally reduces a relative rotation rate of the ratchet wheel 186. Therefore, until the user 14 depresses the actuator 212 and physically actuates the handle 164, the ring 202 prevents unwanted rotation of the ratchet wheel 186 that would lead to a rapid unwinding of the second end 152 and a reduction in the tension of the resistance element 18. Alternatively, the rotation restricting means 200, including the ring 202, can be configured to apply a lesser internal retaining force on the ratchet wheel 186 when the user 14 depresses the actuator 212 whereby the wheel 186 rotates slowly and the second end 152 unwinds slowly from the boss 158 in a steady, controlled manner that does not require physical actuation of the handle 164. In this configuration, actuation of the handle 164 by the user 14 could increase the speed at which the second end 152 unwinds and the reduction in the tension of the resistance element 18.

It is further contemplated that the resistance element 18 is replaceable by removing elements of the adjustable tension mechanism 170 and the first housing cover 112 for maintenance or for installing resistance elements 18 with different mechanical properties or dimensions (e.g., replacing a first element 18 with a thicker, second element 18 to provide even greater draw weight). Additionally, in a non-limiting embodiment, the tension or resistance of the resistance element 18 is adjustable between 10 and 70 pounds by the user 14 via the adjustable tension mechanism 170. Elements and components of the adjustable archery training bow 10, as described above, can be formed from any number of materials, including metals, alloys, polymers, ceramics and composite materials, including plastics and carbon fiber-reinforced polymers.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings. Other implementations are also contemplated.

The invention claimed is:

1. An adjustable archery training bow assembly, comprising:

a main body;

a resistance member disposed between a first end of the main body and a second end of the main body, wherein a first end of the resistance member is fixedly attached to the first end of the main body and a second end of the resistance member is attached to the second end of the main body by an adjustable tension mechanism; and wherein the adjustable tension mechanism includes a release mechanism that permits a user to vary the tension of the resistance member.

2. The adjustable archery training bow assembly of claim 1, wherein the release mechanism includes a ratchet wheel and a release button connected to a pawl.

3. The adjustable archery training bow assembly of claim 2, wherein the release mechanism is configured to move the pawl to an engaged position and a disengaged position.

4. The adjustable archery training bow assembly of claim 3, wherein:

when the pawl is in the engaged position the ratchet wheel is rotatable in only a first direction, said rotation of the ratchet wheel in the first direction is configured to increase the tension in the resistance element; and when the pawl is in the disengaged position the ratchet wheel is rotatable in either the first direction or a second direction, said rotation of the ratchet wheel in the second direction is configured to decrease the tension in the resistance element.

5. The adjustable archery training bow assembly of claim 1, wherein the adjustable tension mechanism includes a lower housing and lower housing cover that is rotatably connected to the lower housing.

6. The adjustable archery training bow assembly of claim 5, wherein a dampening ring is disposed between the lower housing and the lower housing cover.

7. The adjustable archery training bow assembly of claim 1, wherein the main body includes a vibration damper that extends rearward from the main body towards the resistance member.

8. The adjustable archery training bow assembly of claim 1, wherein the main body includes a level.

9. The adjustable archery training bow assembly of claim 1, wherein the main body includes a laser sight.

10. The adjustable archery training bow assembly of claim 9, wherein the laser sight is mounted in a laser port that extends forward from the main body.

11. The adjustable archery training bow assembly of claim 1, wherein a cross sectional diameter of the resistance element varies inversely with a tension adjustment of the resistance member.

12. The adjustable archery training bow assembly of claim 1, wherein a draw weight of the adjustable archery training bow assembly varies directly with a tension adjustment of the resistance member.

13. The adjustable archery training bow assembly of claim 1, wherein the adjustable tension mechanism includes a ratchet wheel, a pawl and a release mechanism operatively connected to the pawl for selectively allowing ratchet wheel rotation.

14. An adjustable archery training bow assembly, comprising:

a main body including: i) a first end ii) a second end, and iii) a vibration damper that extends rearward from the main body towards a single resistance member;

the single resistance member extending between the first end and the second end, wherein the resistance member is rigidly connected to the first end of the main body and the resistance member is adjustably connected to the second end of the main body;

wherein a tension of the resistance member between the first end and the second end is adjustable between a first tension and a second tensions; and wherein the vibration damper is configured to make contact with the resistance element when the resistance element is released from a drawn state by a user.

15. The adjustable archery training bow assembly of claim 14, wherein a cross sectional area of the resistance member varies inversely with a tension adjustment of the resistance member.

16. The adjustable archery training bow assembly of claim 14, wherein a draw weight of the adjustable archery training bow assembly varies directly with a tension adjustment of the resistance member.

17. The adjustable archery training bow assembly of claim 14, wherein the second end of the resistance member is connected to the second end of the main body by an adjustable tension mechanism that permits a user to vary the tension of the resistance member between the first tension and the second tension.

18. The adjustable archery training bow assembly of claim 17, wherein the adjustable tension mechanism includes a ratchet wheel, a pawl and a release mechanism operatively connected to the pawl for selectively allowing ratchet wheel rotation.

19. The adjustable archery training bow assembly of claim 18, wherein the adjustable tension mechanism includes a lower housing and lower housing cover that is rotatably connected to the lower housing.

20. The adjustable archery training bow assembly of claim 14, wherein the main body includes a laser sight that is mounted in a laser port that extends forward from the main body.

* * * * *